US011603781B2

(12) United States Patent
Augustyniak et al.

(10) Patent No.: US 11,603,781 B2
(45) Date of Patent: Mar. 14, 2023

(54) EXHAUST SYSTEM COMPONENT

(71) Applicant: Faurecia Emissions Control Technologies, USA, LLC, Columbus, IN (US)

(72) Inventors: Kurt G. Augustyniak, Brownstown, MI (US); James Egan, Indianapolis, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 442 days.

(21) Appl. No.: 16/779,741

(22) Filed: Feb. 3, 2020

(65) Prior Publication Data

US 2021/0239017 A1 Aug. 5, 2021

(51) Int. Cl.

| | |
|---|---|
| ***F01N 1/08*** | (2006.01) |
| ***F01N 1/14*** | (2006.01) |
| *G10K 11/162* | (2006.01) |

(52) U.S. Cl.

CPC ..... *F01N 1/08* (2013.01); *F01N 1/14* (2013.01); *F01N 2270/06* (2013.01); *F01N 2470/02* (2013.01); *F01N 2470/30* (2013.01); *G10K 11/162* (2013.01)

(58) Field of Classification Search

CPC ..... F01N 1/14; F01N 2270/06; F01N 2470/30

See application file for complete search history.

(56) References Cited

U.S. PATENT DOCUMENTS

| | | | | |
|---|---|---|---|---|
| 2,297,046 A * | 9/1942 | Bourne | F01N 1/02 | 110/184 |
| 4,842,096 A * | 6/1989 | Fujitsubo | F01N 1/24 | 181/254 |
| 5,726,397 A * | 3/1998 | Mukai | F01N 1/003 | 181/255 |
| 6,385,967 B1 * | 5/2002 | Chen | F01N 1/023 | 181/252 |
| 2004/0104071 A1 * | 6/2004 | Wahlstrom | F01N 1/02 | 181/248 |

(Continued)

FOREIGN PATENT DOCUMENTS

| | | |
|---|---|---|
| GB | 760493 A | 10/1956 |
| JP | 04259616 A * | 9/1992 |

(Continued)

OTHER PUBLICATIONS

Machine translation of KR-101794850-B1, accessed Sep. 30, 2022. (Year: 2022).*

(Continued)

*Primary Examiner* — Jonathan R Matthias

(74) *Attorney, Agent, or Firm* — Carlson, Gaskey & Olds, P.C.

(57) ABSTRACT

An exhaust system includes an exhaust component with a wall having an outer surface and an inner surface that defines an internal exhaust gas flow path. At least one opening is formed in the exhaust component to extend through the wall of the exhaust component from the outer surface to the inner surface. A member is formed from a resistive material and is configured to cover the at least one opening. A diverter is positioned adjacent the at least one opening to block at least a portion of the exhaust gas flow path.

25 Claims, 6 Drawing Sheets

(56) References Cited

U.S. PATENT DOCUMENTS

| | | | | |
|---|---|---|---|---|
| 2009/0045006 | A1* | 2/2009 | Kondo | H01M 8/0662 181/252 |
| 2016/0017787 | A1* | 1/2016 | Furuya | F16L 21/02 181/269 |
| 2017/0044965 | A1 | 2/2017 | Wasif et al. | |
| 2018/0080354 | A1 | 3/2018 | Smith | |

FOREIGN PATENT DOCUMENTS

| | | | | |
|---|---|---|---|---|
| JP | 5057825 | B2 * | 10/2012 | F16L 55/041 |
| KR | 2005045795 | A * | 5/2005 | B60K 13/04 |
| KR | 100766807 | B * | 10/2007 | F01N 1/14 |
| KR | 101794850 | B1 * | 11/2017 | |

OTHER PUBLICATIONS

Machine translation of JP-04259616-A, accessed Sep. 30, 2022. (Year: 2022).*

* cited by examiner

EXHAUST SYSTEM COMPONENT

TECHNICAL FIELD

The subject disclosure relates to a vehicle exhaust system component that includes a diverter or constriction feature.

BACKGROUND

Vehicle exhaust systems direct exhaust gases generated by an internal combustion engine to the external environment. These systems are comprised of various components such as pipes, converters, catalysts, filters, etc. The overall system and/or the components are capable of generating undesirable noise as a result of resonating frequencies. Different approaches have been used to address this issue.

For example, components such as mufflers, resonators, valves, etc., have been incorporated into exhaust systems in an attempt to attenuate certain resonance frequencies generated by the exhaust system. The disadvantage of including additional components is an increase in cost and weight. Further, adding components introduces new sources for noise generation. Another approach utilizes one or more openings formed within a pipe that are covered with resistive material to dampen noise; however, with current embodiments exhaust gas can exit through these openings to the external environment.

SUMMARY

According to one exemplary embodiment, an exhaust system includes an exhaust component with a wall having an outer surface and an inner surface that defines an internal exhaust gas flow path. At least one opening is formed in the exhaust component to extend through the wall of the exhaust component from the outer surface to the inner surface. A member is formed from a resistive material and is configured to cover the at least one opening. A diverter is positioned adjacent the at least one opening to block at least a portion of the exhaust gas flow path.

In another embodiment according to the previous embodiment, the exhaust gas flow path extends along an axis from an upstream end to a downstream end, and wherein the diverter comprises a main body with an extension portion that extends inwardly away from the main body and toward the axis.

In another embodiment according to any of the previous embodiments, the at least one opening includes an upstream edge and a downstream edge, and wherein the extension portion is positioned at the upstream edge.

In another embodiment according to any of the previous embodiments, the main body comprises a plate that matches a contour of the outer surface of the exhaust component, the plate including a plate opening that surrounds the at least one opening in the exhaust component, and wherein the extension portion extends inwardly toward the axis along an edge of the plate opening.

In another embodiment according to any of the previous embodiments, the member is positioned on an outer surface of the main body to completely overlap the at least one opening.

In another embodiment according to any of the previous embodiments, a frame is positioned over the member such that the member is directly between the frame and the diverter.

In another embodiment according to any of the previous embodiments, the diverter comprises an extension portion formed as part of the wall of the exhaust component, wherein the extension portion extends radially inwardly along an upstream portion or downstream portion of the at least one opening.

In another embodiment according to any of the previous embodiments, the at least one opening comprises only one opening with a remainder of the exhaust component having a solid wall without any other openings, and wherein the at least one opening is open directly to external atmosphere.

In another embodiment according to any of the previous embodiments, the diverter comprises a constriction directly formed within the exhaust component adjacent to or at the at least one opening.

In another exemplary embodiment, and exhaust system includes an exhaust component with a wall having an outer surface and an inner surface that defines an internal exhaust gas flow path extending along an axis. At least one opening is formed in the exhaust component to extend through the wall of the exhaust component from the outer surface to the inner surface, and a member formed from a resistive material is configured to cover the at least one opening. A diverter, comprising an extension portion, is positioned adjacent to the at least one opening and extends radially inward toward the axis to block at least a portion of the exhaust gas flow path.

In another embodiment according to any of the previous embodiments, the resistive material is a perforated sheet of material.

In another embodiment according to any of the previous embodiments, the at least one opening includes an upstream edge and a downstream edge, and wherein the extension portion is positioned at the upstream edge or downstream edge.

These and other features may be best understood from the following drawings and specification.

BRIEF DESCRIPTION OF THE DRAWINGS

FIG. 11 B shows a comparison of flow velocity and static pressure at an opening in a pipe with a diverter or constriction feature.

DETAILED DESCRIPTION

Figure 1:
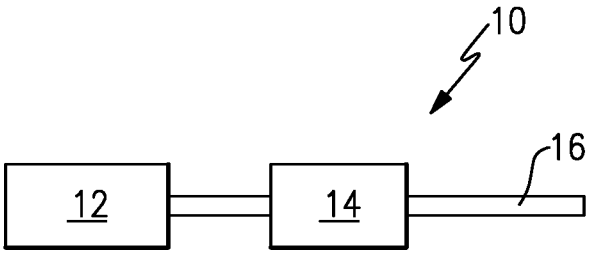
FIG. 1 schematically illustrates one example of an exhaust system.

FIG. 1 shows a vehicle exhaust system 10 that conducts hot exhaust gases generated by an internal combustion engine 12 through various downstream exhaust components 14 to reduce emissions and control noise as known. The exhaust components 14 can include diesel oxidation catalysts (DOC), selective catalytic reduction (SCR) catalysts, particulate filters, mufflers, resonators, exhaust pipes, etc. These components 14 can be mounted in various different configurations and combinations dependent upon vehicle application and available packaging space. Exhaust gas passes through the components 14 and is subsequently directed to the external atmosphere via a tailpipe 16, for example.

Figure 2:
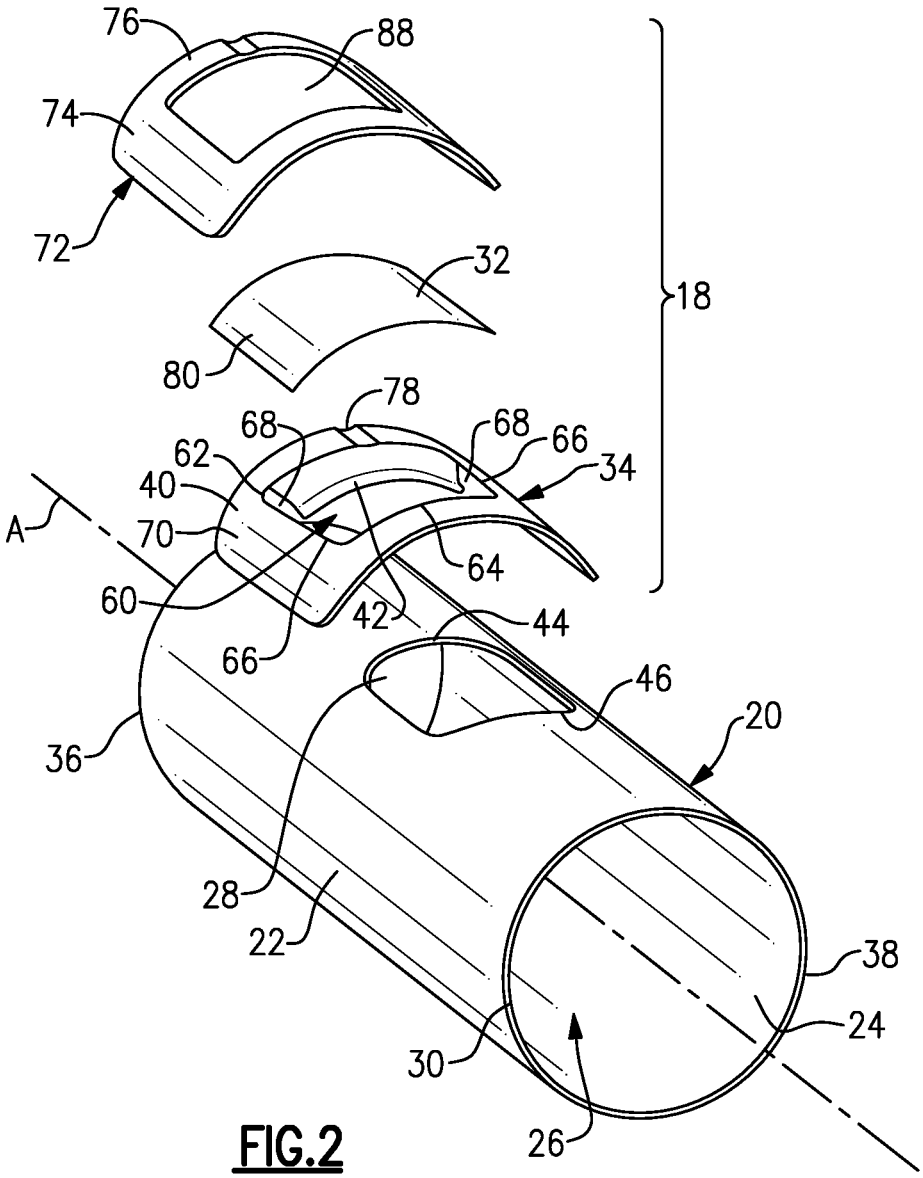
FIG. 2 schematically illustrates one example of a pipe with a diverter or constriction feature as used in the exhaust system of FIG. 1.
Figure 3:
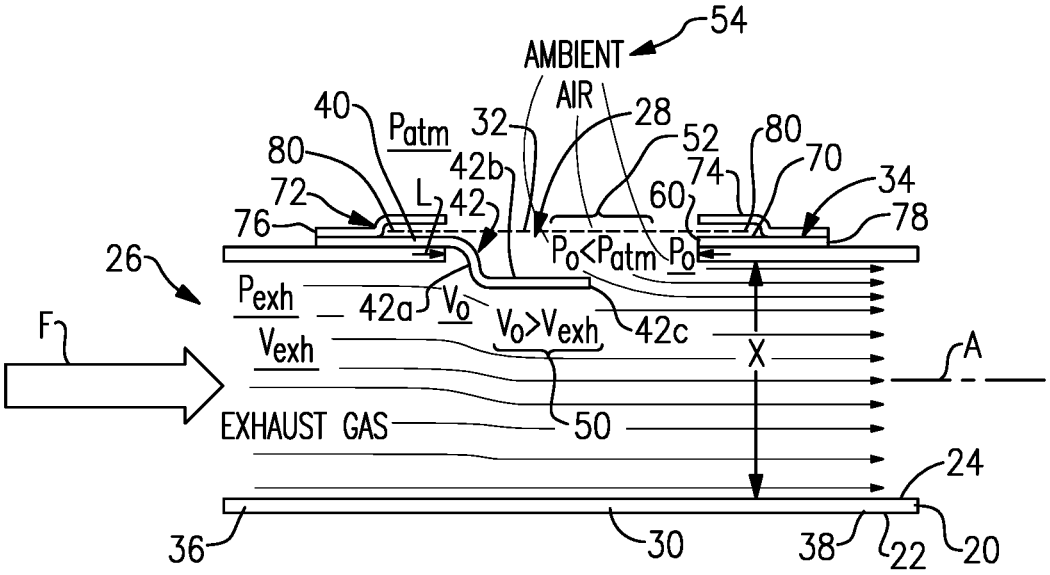
FIG. 3 is a section view through the pipe of FIG. 2.

As shown in FIGS. 2-3, the exhaust system 10 includes an assembly 18 comprising a constriction or diverter feature with an acoustic damping member that dampens resonance frequencies generated during operation of the system 10. In one example, the assembly 18 is used in an exhaust pipe 20 from the system 10; however, it should be understood that while the assembly 18 is shown as being used with a pipe 20, it could also be used in any of the various exhaust components 14 as needed.

The exhaust pipe 20 has an outer surface 22 and an inner surface 24 that defines an internal exhaust component cavity 26 having a center axis A. The inner surface 24 defines an exhaust gas flow path F that flows in a direction along the axis A. At least one opening 28 is formed in the pipe 20 to extend through a wall 30 of the pipe 20 from the outer surface 22 to the inner surface 24.

In one example, the assembly 18 includes a member 32 formed from a resistive material that is configured to cover the opening 28 and a diverter 34 that is configured to extend inwardly away from the inner surface 24 of the pipe 20 adjacent the opening 28 to block at least a portion of the exhaust gas flow path F. In one example, the diverter 34 is configured to provide a constriction feature that is adjacent to the resistive material.

In one example, the resistive material of the member 32 is a perforated sheet of material. The resistive material can comprise a sheet or mat made from a microperforated material, for example. This type of material has a high density of very small openings extending through the sheet. In one example, the microperforated material has approximately 5% porosity. Optionally, other resistive materials could also be used, such as a powdered metal material for example. Further, the microperforated or resistive material provides a specified amount of resistivity, i.e. material resistance (Ns/m3). In one example, material resistance is at least 25 Ns/m3. A preferred range is 50-3000 Ns/m3.

The pipe 20 extends along the axis A from an upstream or first pipe end 36 to a downstream or second pipe end 38. The opening 28 is formed within the pipe 20 between the first 36 and second 38 pipe ends. The diverter 34 comprises a main body 40 with an extension portion 42 that extends inwardly away from the main body 40 and toward the axis A to block a portion of the flow path F. The opening 28 includes an upstream edge 44 and a downstream edge 46. In one example, the extension portion 42 is positioned at the upstream edge 44. In one example, the extension portion 42 includes a first portion 42*a* extending inwardly toward the axis A and a second portion 42*b* extending from the first portion 42*a* in a direction along the axis A to a distal end 42*c*.

This configuration creates a venturi effect by incorporating a localized constriction feature inside the exhaust pipe adjacent to the perforated sheet of the member 32. The localized constriction feature is positioned such that an exhaust gas mean flow travels transversely across the constriction feature and the resistive material is downstream of the constriction feature. As shown in FIG. 3, there is an ambient air pressure Patm, an exhaust gas pressure Pexh, and an internal pressure Po at the opening. Additionally, the exhaust gas has a flow velocity Vexh and there is a velocity Vo at the opening. Due to the constriction feature, an increase in exhaust gas velocity is created (indicated at 50 in FIG. 3) that results in a pressure drop (Po<Patm) on the inside of the pipe 20 adjacent to the opening 28 covered by the resistive material (indicated at 52). The resultant drop in pressure inside the pipe 20 creates a negative or neutral pressure drop across the resistive material. As a result of the neutral or negative pressure drop across the resistive material, a zero-flow or a small ingress of external ambient air is introduced into the pipe (indicated at 54) through the resistive material, which would otherwise have an egress of exhaust gas out of the pipe 20. Thus, the subject disclosure provides a constriction feature in combination with an opening in an exhaust component covered by resistive material to effectively dampen the acoustic resonance while also providing a feature to significantly reduce and/or eliminate a mean exhaust gas flow out of the exhaust component.

The opening 28 is defined by a length L extending in a direction along the axis A. In one example, the distal end 42*c* of the second portion 42*b* terminates at a location that is at a depth that is radially inward of the inner surface 24. A length of the second portion 42*b* overlaps a portion of the length L of the opening 28. The depth, length, and orientation of the extension portion 42 can vary as needed to provide the desired pressure drop at the opening 28.

In one example, the main body 40 comprises a plate that matches a contour of the outer surface 22 of the pipe 20. The plate includes a plate opening 60 that surrounds the opening 28 in the pipe 20. The extension portion 42 extends inwardly toward the axis A along an edge of the plate opening 60. In one example, the plate opening 60 includes an upstream edge 62, a downstream edge 64, and side edges 66 connecting the upstream 62 and downstream 64 edges. The extension portion 42 extends inwardly from the upstream edge and is spaced apart from the side edges 66 by gaps 68 such that the extension portion 42 can extend into the exhaust gas flow path F without contacting edges of the opening 28.

In one example, the member 32 is positioned on an outer surface 70 of the main body 40 to completely overlap the opening 28. In one example, an outer frame 72 is positioned over the member 32 such that the member 32 is directly between the outer frame 72 and the main body 40 of the diverter 34, which serves as an inner frame that includes the constriction feature. In one example, the frame 72 includes a frame body 74 with a center opening 88 and a first peripheral flange 76 extending about a periphery of the frame body 74. The diverter 34 includes a second peripheral flange 78 extending about a periphery of the main body 40 that is directly abutting against the first peripheral flange 76. Outer edges 80 of the member 32 are received within a gap formed between the frame body 74 and the main body 40. The flanges 76, 78 can be welded, brazed, or otherwise fixed to each other and to the pipe 20. The center opening 88 of the frame body 74 overlaps the resistive material and the opening 28 in the pipe 20.

The exhaust gas flow path F has a cross-section X intersecting the axis A as shown in FIG. 3. In one example, the extension portion 42 extends less than halfway across the cross-section X. This relationship can vary as needed to provide the desired pressure drop at the opening 28.

In one example, the at least one opening 28 comprises only one opening with a remainder of the exhaust component having a solid wall without any other openings. In other words, in this example the opening 28 comprises the only opening within the pipe 20. The opening 28 is open directly to external atmosphere.

Figure 4:
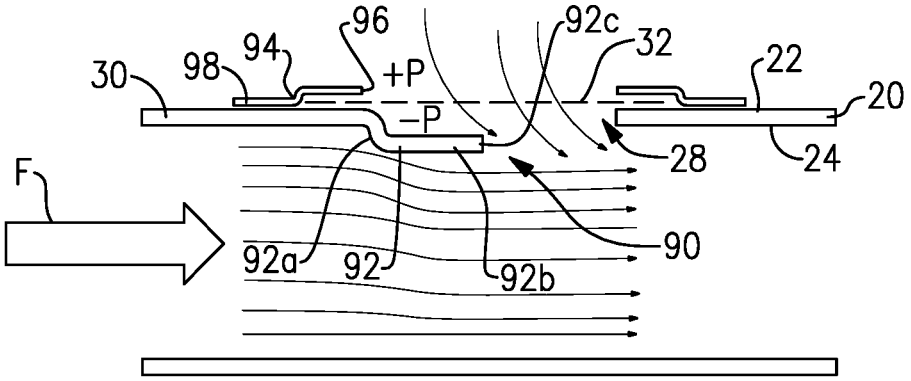
FIG. 4 schematically illustrates another example of a pipe with a diverter or constriction feature.

FIG. 4 shows another example of a diverter configuration. In this example, a diverter 90 is an extension portion 92 formed as part of the wall 30 of the pipe 20. The extension portion 92 extends radially inwardly along an upstream portion of the opening 28. In one example, the extension portion 92 includes a first portion 92*a* extending inwardly toward the axis A and a second portion 92*b* extending from the first portion 92*a* in a direction along the axis A to a distal end 92*c*. The member 32 is positioned on the outer surface 22 of the pipe 20 to completely overlap the opening 28. In one example, an outer frame 94 is positioned over the member 32 such that the member 32 is directly between the outer frame 94 and the pipe 20. In one example, the frame 94 includes a frame body with a center opening 96 and a peripheral flange 98 extending about a periphery of the frame body. The outer edges 80 of the member 32 are received within a gap formed between the frame body and the pipe 20. The peripheral flange 98 can be welded, brazed, or otherwise fixed to the pipe 20 to secure the member 32 in place.

Figure 5:
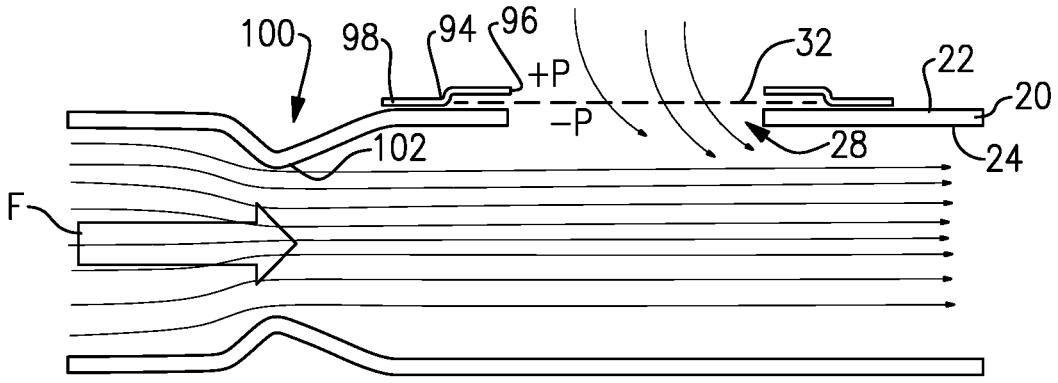
FIG. 5 schematically illustrates another example of a pipe with a diverter or constriction feature.

FIG. 5 shows another example of a diverter configuration. In this example, a diverter 100 comprises a constriction directly formed within the pipe 20 upstream of the opening 28. The constriction comprises an inwardly extending wall portion 102 that forms a narrowing neck or reduced cross-section of the pipe 20. The member 32 is held in place on the pipe 20 with the frame 94 as described above.

Figure 6:
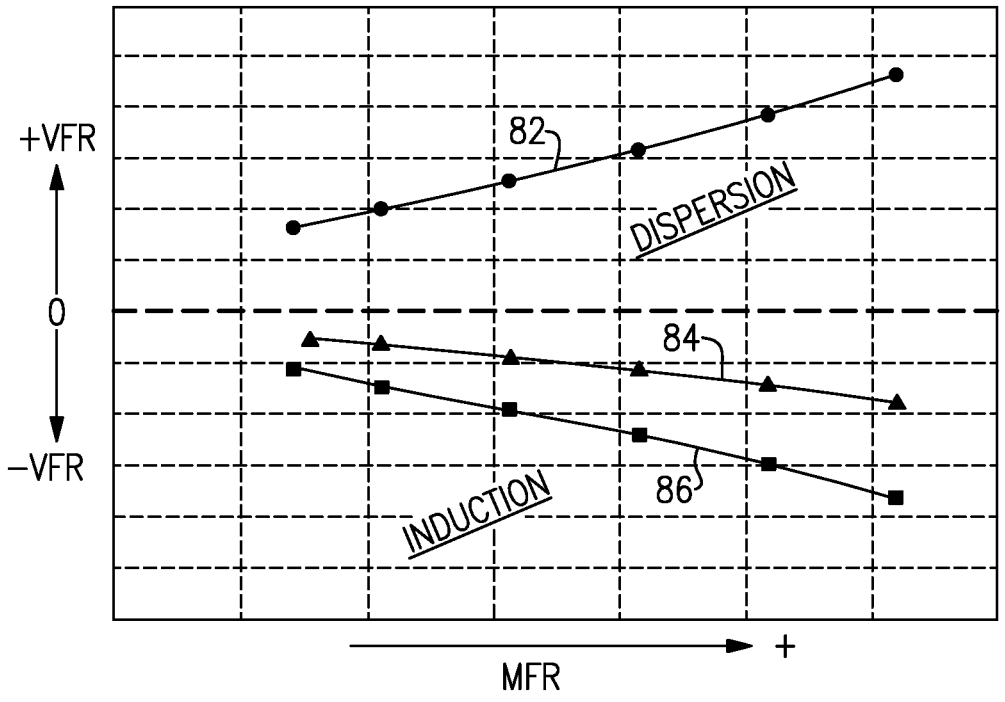
FIG. 6 is a graph of volumetric flow rate vs. mass flow rate for configurations with and without the diverter or constriction feature.

FIG. 6 is a graph of volumetric flow rate vs. mass flow rate for configurations with and without the diverter or constriction feature. A first line 82 shows the plot for a standard pipe without the diverter. A second line 84 shows the plot for a diverter that extends inwardly into the flow path F by a first amount. A third line 86 shows the plot for a diverter that extends inwardly into the flow path F by a second amount that is greater than the first amount. Both diverter configurations provide for a pressure drop.

Figure 7:
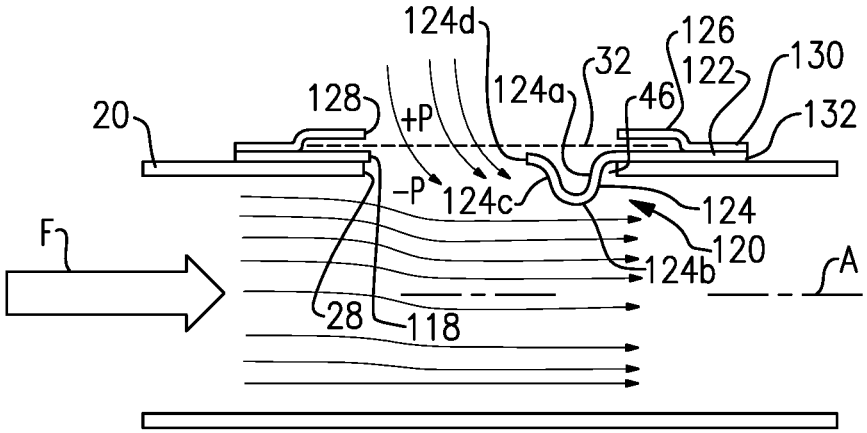
FIG. 7 schematically illustrates another example of a pipe with a diverter or constriction feature.

FIG. 7 shows another example of a diverter configuration. In this example, a diverter 120 comprises an inner frame 122 with an inner opening 118 and an extension portion 124 that extends inwardly away from the inner frame 122 and toward the axis A to block a portion of the flow path F. In one example, the extension portion 124 is positioned at the downstream edge 46 of the opening 28 in the pipe 20. In one example, the extension portion 124 includes a first portion 124*a* extending inwardly toward the axis A, a second portion 124*b* extending from the first portion 124*a* and curving in a direction along the axis A, and a third portion 124*c* extending radially outward from the second portion 124*b* to a distal end 124*d*.

The member 32 is positioned directly between the inner frame 122 and an outer frame 126 to completely overlap the opening 28. In one example, the outer frame 126 includes a center opening 128 and a first peripheral flange 130. The inner frame 122 includes a second peripheral flange 132 that extends about a periphery of the inner frame 122, and which directly abuts against the first peripheral flange 130. Outer edges of the member 32 are received within a gap formed between the inner 122 and outer 126 frames. The flanges 130, 132 can be welded, brazed, or otherwise fixed to each other and to the pipe 20. The center opening 128 of the outer frame 126 overlaps the opening 118 in the inner frame 122 and the opening 28 in the pipe 20.

Figure 8:
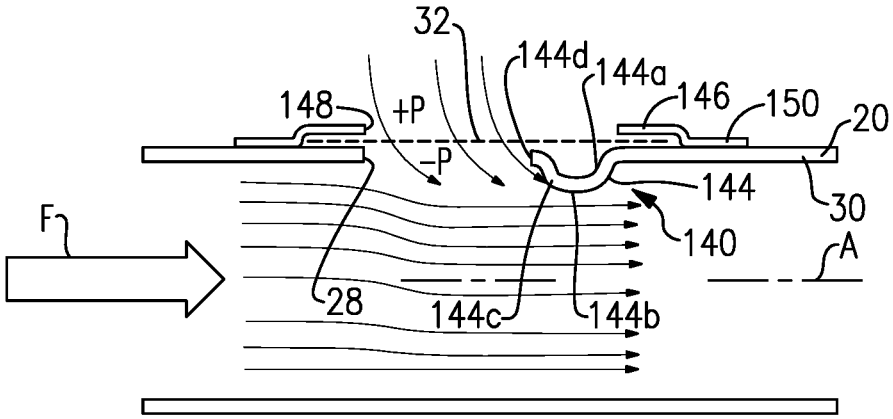
FIG. 8 schematically illustrates another example of a pipe with a diverter or constriction feature.

FIG. 8 shows another example of a diverter configuration. In this example, a diverter 140 is an extension portion 144 formed as part of the wall 30 of the pipe 20. In this example, the extension portion 144 extends radially inwardly along a downstream portion of the opening 28. In one example, the extension portion 144 includes a first portion 144*a* extending inwardly toward the axis A, a second portion 144*b* extending from the first portion 144*a* and curving in a direction along the axis A, and a third portion 144*c* extending radially outward from the second portion 144*b* to a distal end 144*d*. The member 32 is positioned on the outer surface 22 of the pipe 20 to completely overlap the opening 28. In one example, an outer frame 146 is positioned over the member 32 such that the member 32 is directly between the outer frame 146 and the pipe 20. In one example, the frame 146 includes a frame body with a center opening 148 and a peripheral flange 150 extending about a periphery of the frame body. The outer edges of the member 32 are received within a gap formed between the frame body and the pipe 20. The peripheral flange 150 can be welded, brazed, or otherwise fixed to the pipe 20 to secure the member 32 in place.

Figure 9:
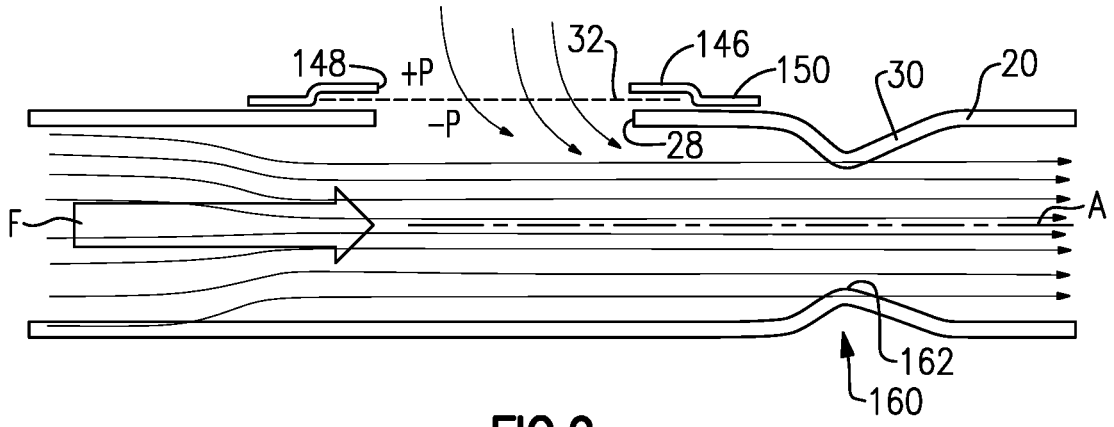
FIG. 9 schematically illustrates another example of a pipe with a diverter or constriction feature.

FIG. 9 shows another example of a diverter configuration. In this example, a diverter 160 comprises a constriction directly formed within the pipe 20 downstream of the opening 28. The constriction comprises an inwardly extending wall portion 162 that forms a narrowing neck or reduced cross-section of the pipe 20. The member 32 is held in place on the pipe 20 with the frame 146 as described above.

Figure 10:
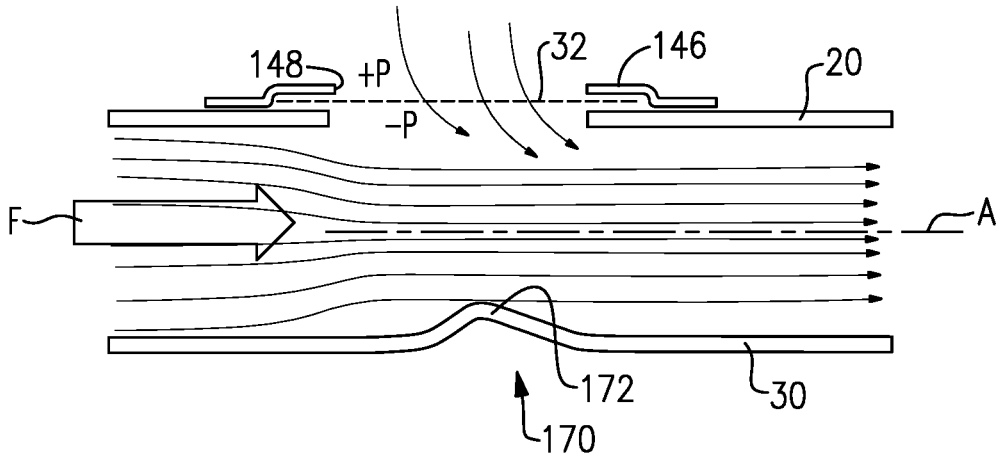
FIG. 10 schematically illustrates another example of a pipe with a diverter or constriction feature.

FIG. 10 shows another example of a diverter configuration. In this example, a diverter 170 comprises a constriction directly formed within the pipe 20 at a location that at least partially overlaps the opening 28 in the radial direction. The constriction comprises an inwardly extending wall portion 172 that forms a reduced cross-section of the pipe 20 at the opening 28. The wall portion 172 is positioned opposite of the member 32 and thus does not extend completely about the periphery of the pipe 20. The member 32 is held in place on the pipe 20 with the frame 146 as described above.

The subject disclosure provides a diverter or constriction feature in combination with an opening in an exhaust component covered by resistive material that reduces the egress of mean exhaust gas flow out of the opening. The inclusion of the diverter or constriction generates a net zero or negative differential pressure inside of the exhaust component at the interface of the resistive material and opening to prevent a net exhaust gas flow out of the component. Further, there is minimal effects on back pressure with the disclosed configuration.

In each of the disclosed examples, a shape is formed in the pipe itself or an additional component is provided to change exhaust gas flow conditions at the opening 28 in the pipe 20. In one example, this is accomplished by diverting or directing the exhaust gas flow F away from the opening 28. In another example, this is accomplished by changing the geometry of the pipe 20 to cause the exhaust gas flow to speed up at the opening 28. As the velocity increases, the static pressure drops at the opening. When the static pressure in the region of the opening 28 is lower (−P) than atmospheric pressure (+P), the exhaust gas will not flow outward from inside the pipe, and instead ambient air A will flow inward from outside the pipe.

Figure 11A:
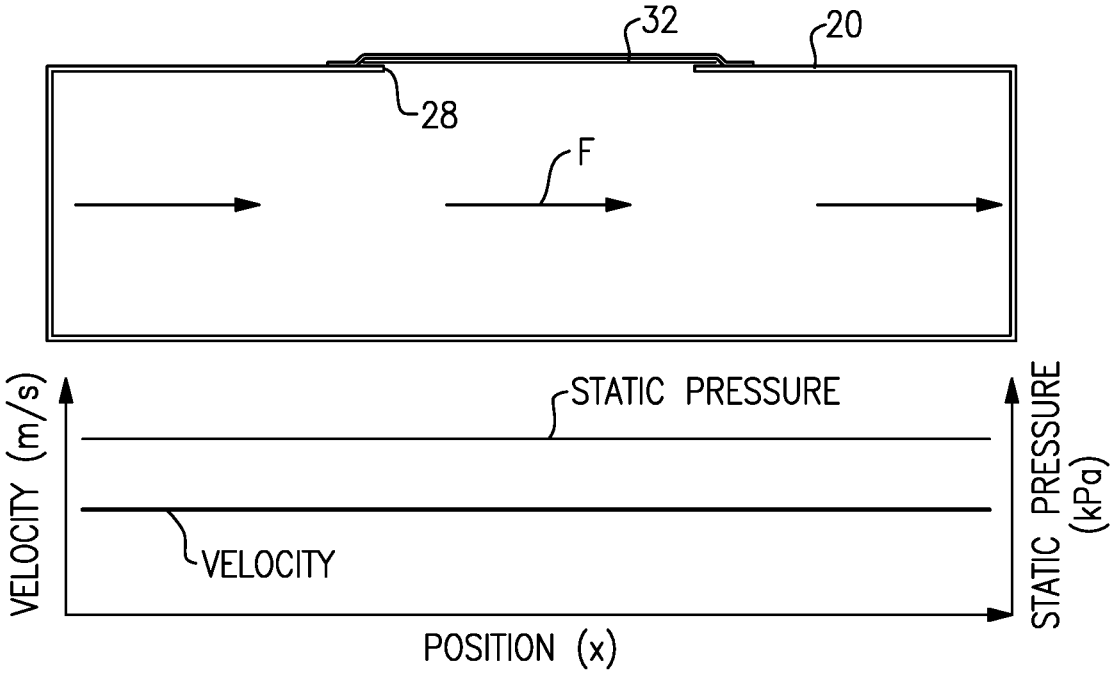
FIG. 11 A shows a comparison of flow velocity and static pressure at an opening in a pipe without a diverter or constriction feature.
Figure 11B:
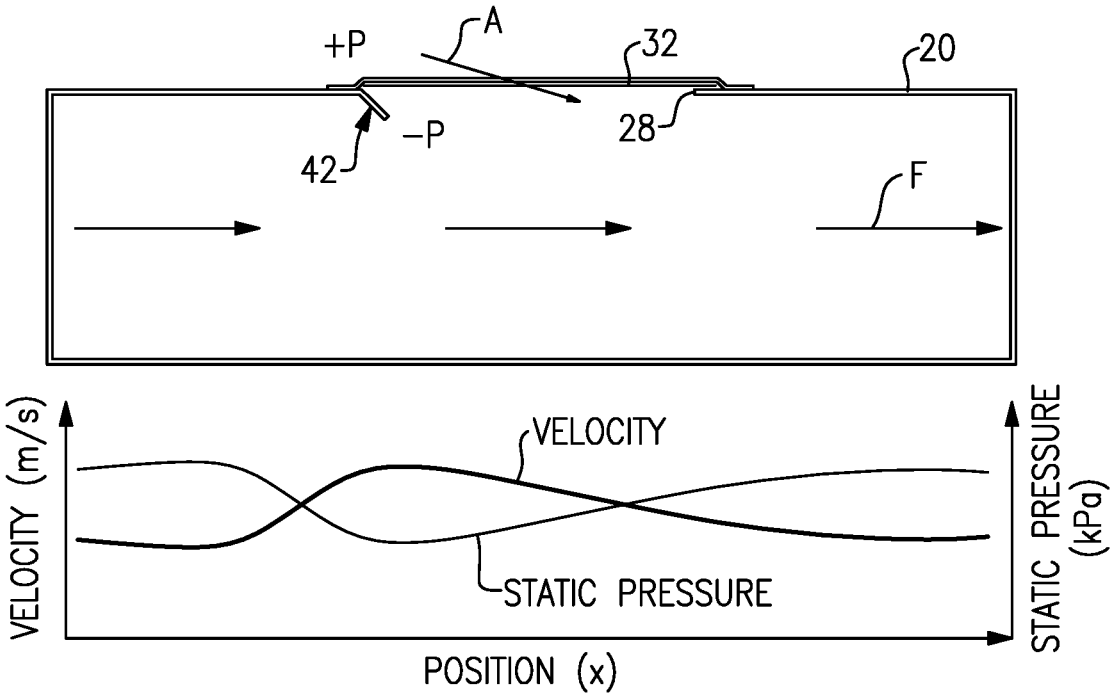

FIG. 11A shows a comparison of flow velocity and static pressure at an opening 28 in a pipe 20 without a diverter or constriction feature. FIG. 11B shows a comparison of flow velocity and static pressure at an opening 28 in a pipe 20 with a diverter or constriction 42. FIG. 11B shows that the static pressure decreases at the opening 28 while the flow velocity increases. FIG. 11B is just one schematic example of this phenomenon. The shape of the curves and the locations of the intersections of the velocity and pressure will vary dependent upon the location of the diverter or constriction feature within the pipe.

Although various embodiments have been disclosed, a worker of ordinary skill in this art would recognize that certain modifications would come within the scope of this disclosure. For that reason, the following claims should be studied to determine the true scope and content of this invention.

The invention claimed is:

1. An exhaust system comprising:

an exhaust component with a wall having an outer surface and an inner surface that defines an internal exhaust gas flow path;

at least one opening formed in the exhaust component to extend through the wall of the exhaust component from the outer surface to the inner surface, and wherein the at least one opening is open directly to external atmosphere;

a member formed from a resistive material and configured to cover the at least one opening, wherein the member comprises a sheet of resistive material having edges that are held fixed against the exhaust component with at least one mount structure; and a diverter positioned adjacent the at least one opening to block at least a portion of the exhaust gas flow path.

2. The exhaust system according to claim 1 wherein the exhaust gas flow path extends along an axis from an upstream end to a downstream end, and wherein the diverter comprises a main body with an extension portion that extends inwardly away from the main body and toward the axis.

3. The exhaust system according to claim 2 wherein the at least one opening includes an upstream edge and a downstream edge, and wherein the extension portion is positioned at the upstream edge.

4. The exhaust system according to claim 2 wherein the extension portion includes a first portion extending inwardly toward the axis and a second portion comprising a distal end that extends in a direction along the axis.

5. The exhaust system according to claim 4 wherein the at least one opening is defined by an upstream edge and a downstream edge, and wherein the extension portion is positioned at the downstream edge.

6. The exhaust system according to claim 2 wherein the main body comprises a plate that matches a contour of the outer surface of the exhaust component, the plate including a plate opening that surrounds the at least one opening in the exhaust component, and wherein the extension portion extends inwardly toward the axis along an edge of the plate opening.

7. The exhaust system according to claim 2 wherein the member is positioned on an outer surface of the main body to completely overlap the at least one opening.

8. The exhaust system according to claim 7 wherein the at least one mount structure comprises a frame positioned over the member such that the member is directly between the frame and the diverter.

9. The exhaust system according to claim 8 wherein the frame includes frame body with a first peripheral flange extending about a periphery of the frame body and the diverter includes a second peripheral flange extending about a periphery of the main body that is directly abutting against the first peripheral flange, and wherein outer edges of the member are received within a gap formed between the frame body and the main body.

10. The exhaust system according to claim 1 wherein the diverter comprises an extension portion formed as part of the wall of the exhaust component, wherein the extension portion extends radially inwardly along an upstream portion or downstream portion of the at least one opening.

11. The exhaust system according to claim 1 wherein the at least one opening comprises only one opening with a remainder of the exhaust component having a solid wall without any other openings.

12. The exhaust system according to claim 1 wherein the sheet of resistive material is a perforated sheet of material having a material resistance in a range of 50-3000 Ns/m3.

13. The exhaust system according to claim 1 wherein the diverter comprises a constriction directly formed within the exhaust component adjacent to or at the at least one opening.

14. The exhaust system according to claim 1 wherein the at least one opening comprises a discrete hole that extends through a thickness of the wall.

15. The exhaust system according to claim 14 wherein the at least one mount structure comprises a frame.

16. An exhaust system comprising:

an exhaust component with a wall having an outer surface and an inner surface that defines an internal exhaust gas flow path extending along an axis;

at least one opening formed in the exhaust component to extend through the wall of the exhaust component from the outer surface to the inner surface, and wherein the at least one opening comprises a discrete hole that extends through a thickness of the wall;

a member formed from a resistive material and configured to cover the at least one opening; and a diverter comprising an extension portion positioned adjacent to the at least one opening and extending radially inward toward the axis to block at least a portion of the exhaust gas flow path.

17. The exhaust system according to claim 16 wherein the at least one opening includes an upstream edge and a downstream edge, and wherein the extension portion is positioned at the upstream edge or downstream edge.

18. The exhaust system according to claim 17 wherein the extension portion includes a first portion extending inwardly toward the axis and a second portion comprising a distal end that extends in a direction along the axis.

19. The exhaust system according to claim 18 wherein the diverter includes a main body that comprises a plate that matches a contour of the outer surface of the exhaust component, the plate including a plate opening that surrounds the at least one opening in the exhaust component, and wherein the extension portion extends inwardly toward the axis along the upstream edge or downstream edge of the plate opening.

20. The exhaust system according to claim 19 wherein the member is positioned on an outer surface of the main body to completely overlap the at least one opening, and including a frame positioned over the member such that the member is directly between the frame and the diverter.

21. The exhaust system according to claim 16 wherein the extension portion is formed as part of the wall of the exhaust component, and wherein the extension portion extends radially inwardly along an upstream portion or downstream portion of the at least one opening.

22. The exhaust system according to claim 16 wherein the extension portion comprises an inwardly extending wall portion of the exhaust component that forms a constriction adjacent to or at the at least one opening.

23. The exhaust system according to claim 16 wherein the member comprises a sheet of resistive material having edges that are held fixed against the exhaust component with at least one mount structure.

24. The exhaust system according to claim 23 wherein the at least one mount structure comprises a frame.

25. The exhaust system according to claim 16 wherein the at least one opening comprises only one opening with a remainder of the exhaust component having a solid wall without any other openings.

* * * * *